United States Patent [19]

Casey

[11] Patent Number: 4,878,258

[45] Date of Patent: Nov. 7, 1989

[54] MODULAR ENERGY SAVING COVERING

[76] Inventor: Susan D. Casey, 243 W. 72nd St. #7, New York, N.Y. 10023

[21] Appl. No.: 246,362

[22] Filed: Sep. 19, 1988

[51] Int. Cl.[4] ..... A47G 9/06

[52] U.S. Cl. ..... 5/420; 5/502; 5/455; 5/465; 2/441; 24/574; 24/697; 52/592; 160/368.1

[58] Field of Search ..... 5/417, 420, 482, 500, 5/502, 465, 455; 2/275, DIG. 2, 441; 160/126, 368.1; 52/592; 24/573, 697

[56] References Cited

U.S. PATENT DOCUMENTS

| | | | |
|---|---|---|---|
| 356,624 | 1/1887 | Curtis | 2/275 |
| 774,996 | 11/1904 | Starkwather | 5/442 |
| 1,267,042 | 5/1918 | Arnold . | |
| 1,574,405 | 2/1926 | Moulton | 2/275 |
| 1,668,373 | 5/1928 | Krasity | 5/465 |
| 2,174,831 | 10/1939 | Muller | 2/275 |
| 2,660,735 | 12/1953 | Baum | 5/500 |
| 2,730,728 | 1/1956 | Roberts . | |
| 2,808,596 | 10/1957 | Schreiner . | |
| 3,154,798 | 11/1964 | Harris et al. . | |
| 3,273,176 | 9/1966 | Millar . | |
| 3,530,516 | 9/1970 | Marquette . | |
| 3,863,387 | 2/1975 | Webster et al. | 5/420 |
| 4,005,499 | 2/1977 | Klein . | |
| 4,242,767 | 1/1981 | McMullen et al. | 5/465 |
| 4,459,714 | 7/1984 | Lin | 5/465 |
| 4,631,765 | 12/1986 | Casey | 5/417 |

FOREIGN PATENT DOCUMENTS

| | | | |
|---|---|---|---|
| 516218 | 6/1953 | Belgium | 5/417 |

*Primary Examiner*—Alexander Grosz
*Attorney, Agent, or Firm*—Marshall & Melhorn

[57] ABSTRACT

An energy saving covering module includes a central body portion having a pair of spaced apart walls defining an interior space containing insulating material. A first flange extends from the peripheral edges of the central body portion. A second flange can extend from either the central body portion or the outer peripheral edge of the first flange for overlying the first flange on an adjacent covering module to form an infiltration barrier against the transmission of heat energy and water vapor. The second flange can be either symmetrical or asymmetrical with respect to the first flange. A symmetrical or an asymmetrical third flange can extend from the central body portion on the opposite side of the first flange from the second flange and cooperate with the first flange of an adjacent covering module to form an infiltration barrier. The module is formed of flexible material which can be waterproof and any suitable fastener can be utilized to attach the modules together.

24 Claims, 7 Drawing Sheets

MODULAR ENERGY SAVING COVERING

U.S. Pat. No. 4,631,765 is incorporated herein by reference.

BACKGROUND OF THE INVENTION

The invention generally concerns energy saving covers and, in particular, modules which are adapted to be detachably connected to one another to form a sheet which functions as a barrier to the transfer of heat energy.

Many forms of quilts or covers are shown in the prior art which are comprised of sections detachably connected to one another. For example, U.S. Pat. No. 4,631,765 discloses a covering module formed of a pair of sheets of flexible material superposed and connected along adjacent marginal edges, leaving at least one opening, and a strip of flexible material is connected to the marginal edges of one of the sheets with the sheets being turned inside out. Stuffing material is then inserted through the opening into the interior of the module, and connection of the sheets and strip at a location interior of the marginal edges thereby closes the opening. Fasteners are attached to the marginal edges to permit detachable connection of the modules.

U.S. Pat. No. 1,267,042 discloses an insulated quilt structure including two longitudinal panels detachably connected to each other with flaps to overlap the area where the panels are connected. The detachable panels facilitate handling during laundering and mending. Alternate means of fastening the panels together include a ball and socket connection, buttons and holes, and hooks and loops.

U.S. Pat. No. 2,808,596 discloses a mattress cover formed with openings to foster ventilation and circulation of air therethrough. The mattress cover is formed of a pair of transversely extending end panels detachably connected to an intermediate panel by means of a cord laced through eyes on the connecting portion of the panels. When worn out, a panel may be removed and a new one attached, thereby extending the life of the overall assembly.

U.S. Pat. No. 3,273,176 discloses a blanket possessing a detachable and replaceable sanitary panel extending transversely at the head of the blanket. Numerous means for detachable connection of the panel to the blanket body are disclosed including zippers and snap fasteners, for example.

U.S. Pat. No. 3,530,516 discloses a blanket having two longitudinally arranged panels which are detachably connected by a slide type fastener on the connecting edges of the panels. The panels may be individualized to suit the occupant of the bed by selecting the thickness of insulative quality of the blanket material of which each panel is made.

U.S. Pat. No. 4,005,499 discloses a bed cover, such as a blanket or sheet, which includes two partially overlapping panels, longitudinally arranged in relation to the structure and detachably connected to one another by means of fabric ties on the overlapping edges of the panels. The panels may be individualized to suit the occupant of the bed from the standpoint of the color and texture of the fabric of which the panel is made and by insertion of a scented or medicated sachet in a pocket structure incorporated in each panel.

SUMMARY OF THE INVENTION

The present invention concerns energy saving covering modules adapted to be detachably connected to one another to form blankets, quilts, window coverings, tents, seat cushions, floatation cushions, and the like. Each module is pillow-like and can be of a regular or irregular geometric shape(s). The modules are constructed from at least a pair of flexible sheets superposed and connected at a predetermined distance along their marginal edges leaving an opening typically at a corner. The assembly is then stuffed and the opening closed. Affixed along the marginal edge of the module at regular, predetermined intervals are fasteners of a type suitable for detachably connecting the modules together. The flexible material can be waterproof and gas impermeable material or an internal bladder can be used to provide insulating and floatation properties.

When the modules are connected together, their marginal edges overlap one another, thereby creating an insulating vapor barrier to protect against sound and temperature changes. Each covering module has an insulated central body portion surrounded by an outwardly extending first flange. This first flange overlaps the first flanges of adjacent covering modules to form an infiltration barrier. In a second embodiment, a second flange is formed on each of the covering modules extending from the central body portions beyond the outer periphery of the first flange. The second flanges overlie the first flanges of adjacent covering modules to create the infiltration barrier. In a third embodiment, a third flange extends from the central body portion on the opposite side of the first flange from the second flange. Both the second flange and the third flange can overlie the first flange of the adjacent covering module to form a double infiltration barrier. The second and third flanges can be symmetrical or asymmetrical with respect to the first flange to provide a variety of infiltration barriers and, when combined with different types and locations of fastener means, render the covering modules capable of being reversed and/or oriented to form numerous patterns and shapes of modular coverings. Any suitable form of fastener means can be utilized.

It is an object of this invention to provide energy saving quilt modules adapted to be detachably connected to one another to form coverings of various shapes, designs and configurations.

It is another objective of this invention to provide energy saving quilt modules detachably connected to each other to be assembled in various ways to alter the pattern of color or texture of a shape, design or configuration.

The energy saving modules may be used, for example, individually as seat cushions or pillows, or assembled to form various structures such as quilts, sleeping bags, ground pads and insulative window and wall coverings, or assembled and fitted over a frame to form a tent or housing structure. The present invention has many commercial and military uses.

When energy saving modules possessing covers of different colors or textures are used, they may be assembled and reassembled to vary the pattern possessed by a structure. Furthermore, modules having covers of a different color or texture on each side may be inverted and attached, thereby increasing the variety of patterns of color and texture possible in an assembled structure.

The use of the overlapping marginal edges of the present invention provides an insulative vapor barrier at the attachment interface between the modules. The insulative vapor barrier provides for increased insulative properties thereby saving the heat energy normally lost through more conventional designs.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
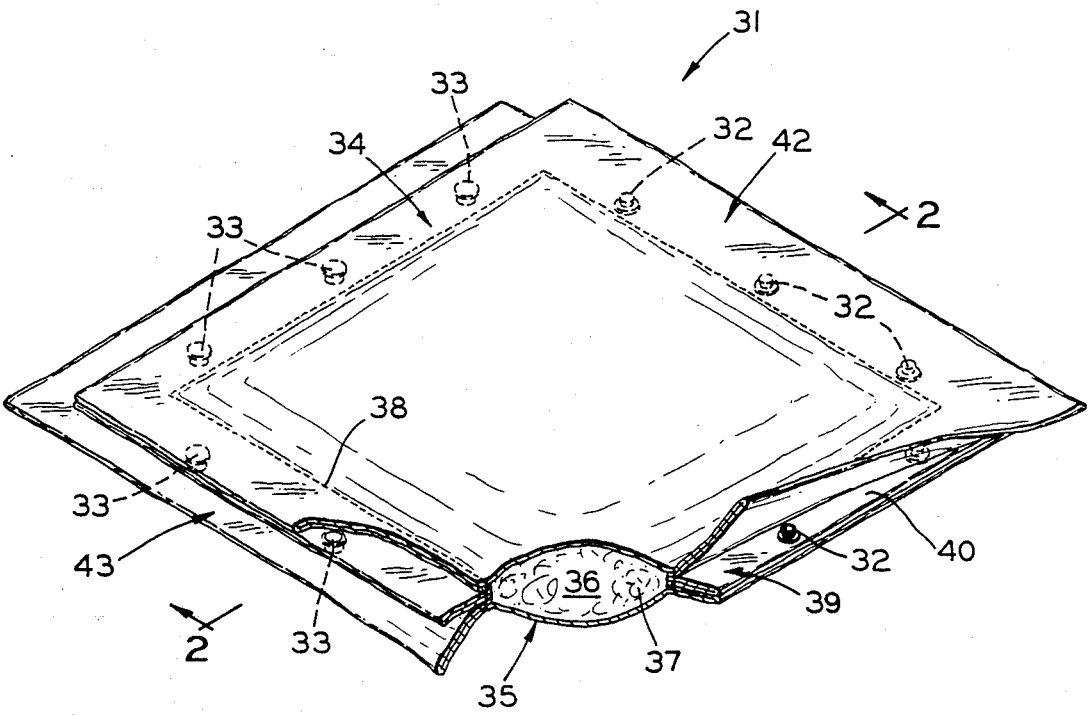
FIG. 1 is a cut-away perspective view of a covering module according to the present invention.
Figure 2:
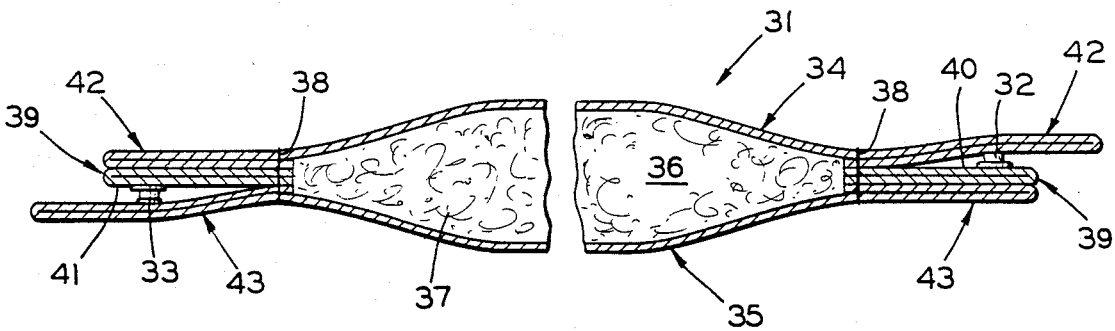
FIG. 2 is cross-sectional view taken along the line 2—2 in FIG. 1.

Referring now to FIG. 1 and FIG. 2, a covering module 31 is shown which is generally square in shape. However, the shape and size of the module can very according to preference and intended use taking into account such factors such as reversibility, interchangeability, and orientation. A plurality of male type snap fastener means 32 and a plurality of female type snap fastener means 33 are affixed to the covering module at predetermined, spaced apart locations on each of the marginal edges. The snap fasteners are arranged so that the fasteners of the male type 32 are attached to two adjacent marginal edges and the fasteners of the female type 33 are attached to the remaining two adjacent marginal edges of the module 31. The snap fasteners 32 and 33 are representative of a myriad of other fastener means providing detachable connection, some of which are presented below.

The covering module 31 can be formed of a pair of sheets of any suitable flexible material including water or gas impermeable material. For example, a top sheet 34 and bottom sheet 35 can be fastened together to form an enclosed interior space 36. The interior space 36 can be filled with a stuff material 37 suitable for padding or insulation. The sheets 34 and 35 can be fastened together by any suitable means such as stitching 38 which is spaced inwardly from the marginal edges of the sheets 34 and 35 so as to form at least one peripheral flange. Such a module having a single flange about its entire periphery is shown in U.S. Pat. No. 4,631,765.

The covering module 31 is formed with three flanges along each peripheral edge to provide an interlocking vapor barrier tending to militate against the transfer of heat energy and water vapor from one side to the other side of the covering module. The stitching 38 defines the periphery of a central portion of the covering module 31 from which the flanges extend. A first central flange 39 is of even width and extends around the entire periphery of the central portion of a covering module 31. The male snap fastener means 32 are attached to an upper surface 40 of the first central flange 39 along two adjacent sides. The female snap fastener means 39 along the remaining two adjacent sides.

The covering module 31 includes a second outer flange 42 which is located above the center flange 39 in the drawings. The outer flange 42 is asymmetric with respect to the central flange 39. The outer flange 42 has approximately the same width as the central flange 39 along the two sides of the module where the female snap fastener means 33 are attached. The two sides of the outer flange 42 which are adjacent the two sides of the central flange 39 having the male snap fastener means attached extend beyond and overhang the peripheral edge of the central flange 39. In a similar manner, a third outer flange 43 shown as located below the central flange 39 in the drawings extends outwardly from the periphery of the central portion of the covering module 31. The third outer flange 43 is also asymmetric with the two sides adjacent the two sides of the central flange 39 to which the male snap fastener means 32 are attached being approximately equal in width to the central flange 39. At the other two sides, the third outer flange 43 extends beyond and overhangs the central flange 39 where the female snap fastener means 33 are attached. Thus, when two of the covering modules 31 are coupled together, the overhanging portions of the outer flanges 42 and 43 tend to overlap and seal against the passage of air and water vapor.

Figure 3:
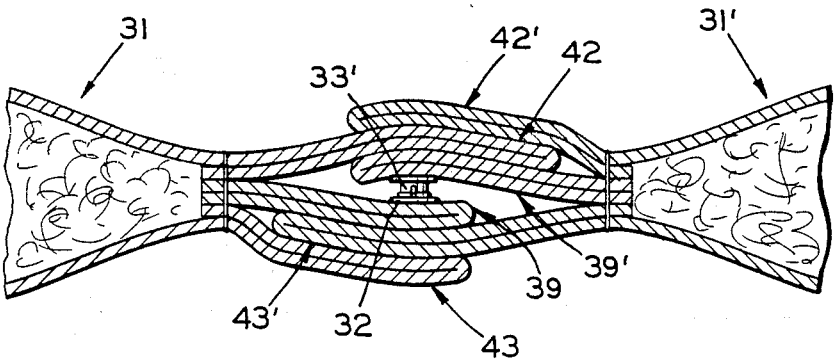
FIG. 3 is a fragmentary cross-sectional view of two of the covering modules of FIG. 1 coupled together.
Figure 4:
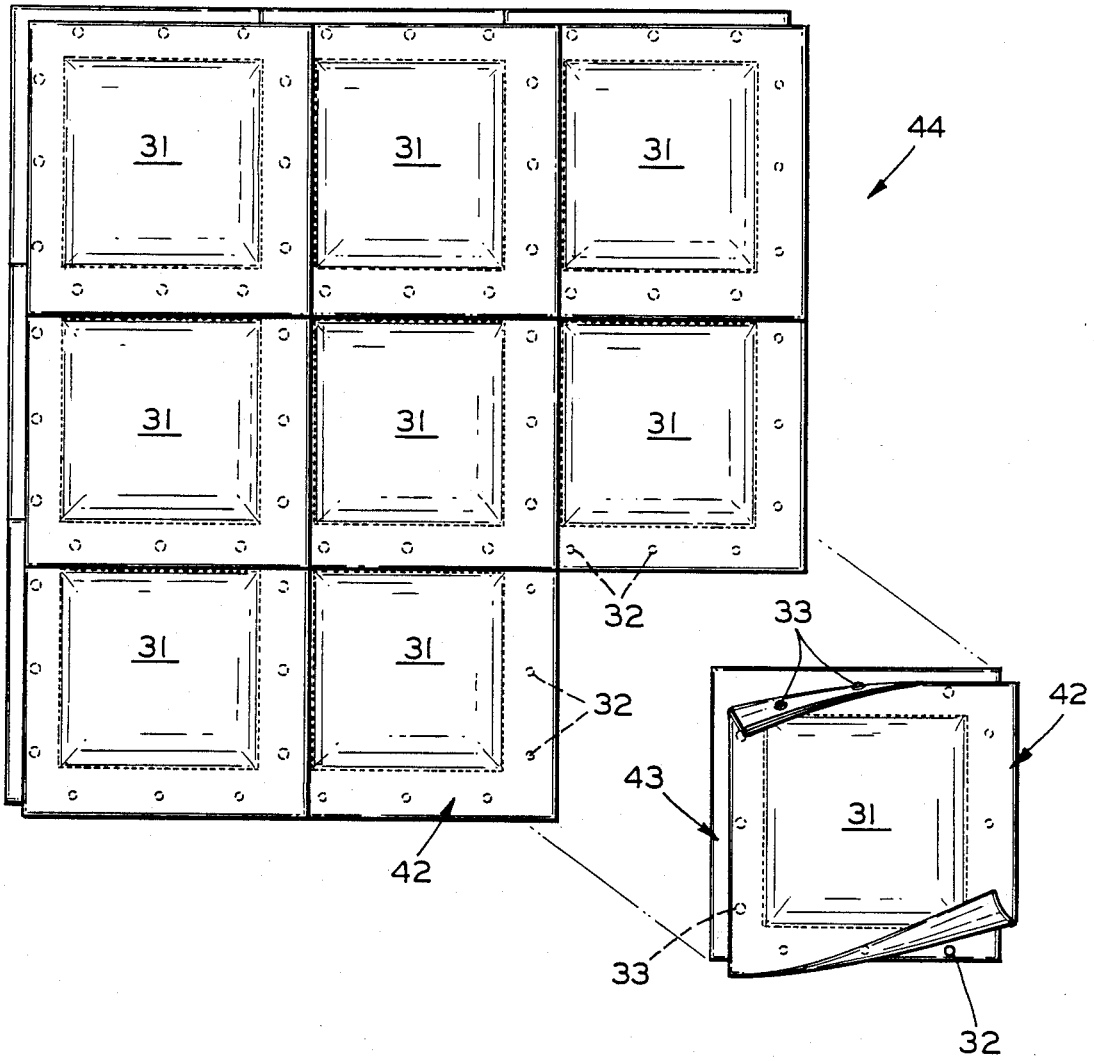
FIG. 4 is a top plan view of a plurality of the covering modules shown in FIG. 1 coupled together to form a modular energy saving covering according to the present invention.

For example, as shown in FIG. 3, a first covering module 31 is coupled to a second covering module 31' by the engagement of the male snap fastener means 32 of the module 31 with a female snap fastener means 33' of the module 31'. The module 31' has a second outer flange 42' and a first central flange 39' which accept between them and cover the overhang of the second outer flange 42 of the module 31. Similarly the first central flange 39 and the third outer flange 43 of the module 31 accept between them and cover the overhanging portion of a third outer flange 43' of the module 31'. Thus, the three flanges of each of the modules overlap and seal the areas between the central portions of the modules. There is shown in FIG. 4 a plurality of the covering modules 31 which are coupled together to form a modular energy saving covering 44 according to the present invention. Due to the location of the snap fastener means 32 and 33, each of the modules 31 can only be orientated in one direction and the modules are not individually reversible.

Figure 5:
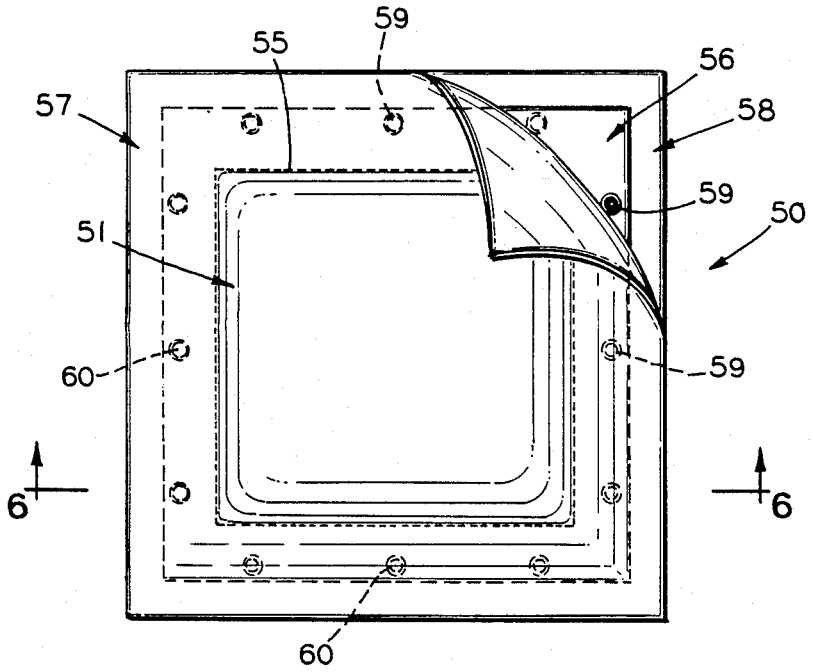
FIG. 5 is a top plan view of a second embodiment of a covering module according to the present invention.
Figure 6:
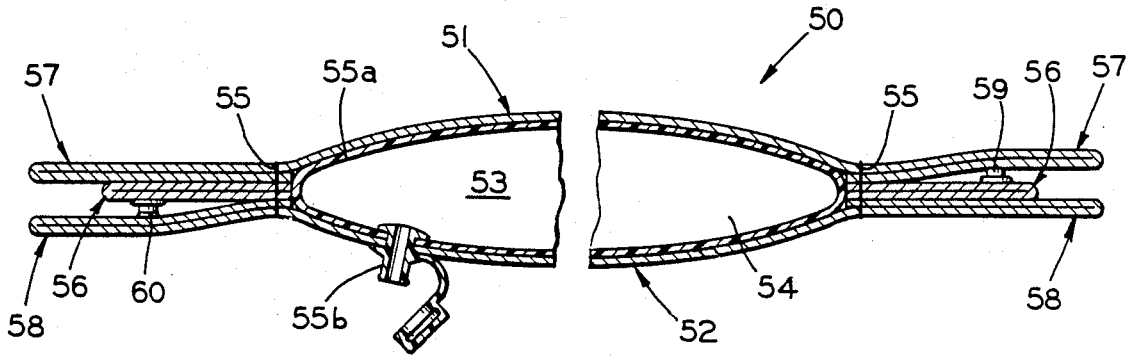
FIG. 6 is a cross-sectional view taken along the line 5—5 in FIG. 5.

There is shown in FIG. 5 and FIG. 6 a covering module 50 which has a three flange symmetrical configuration. A top sheet 51 and a bottom sheet 52 of flexible material define an interior space 53 between them. The interior space 53 is filled with a stuffing or insulation material 54. The interior space 53 is defined by and the stuffing 54 is retained by any suitable means such as stitching 55 for defining the marginal edges of a central portion of the covering module 50. If the insulation material 54 is a gas such as air, then gas impermeable must be utilized for the sheets 51 and 52 and marginal edges at the stitching 55 must be sealed against leakage. Another means for retaining the gas is a bladder **55*a* positioned in the interior space 53. Gas can be pumped in and removed from the bladder 55*a* through a conventional valve stem 55*b* which extends through the sheet 51 and the wall of the bladder 55*a*. Not only will the gas filled bladder 55*a* improve the insulating properties of the module 50**, but it can also serve as a floatation device "Bladder" may be of the self-sealing fabric which is gas/air tight at seams or molded.

Extending from the edges of the central portion of the covering module 50 are a first central flange 56, a second outer flange 57 positioned above the flange 56 and a third outer flange 58 positioned below the central flange 56. Attached to an upper surface of the central flange 56 along two sides are a plurality of male snap fastener means 59 located at a predetermined spacing. Similarly, a plurality of female snap fastener means 60 are attached to a lower surface of the remaining two sides of the central flange 56. The second outer flange 57 and the third outer flange 58 each extend beyond the peripheral edge of the first central flange 56 on all sides of the covering module 50 to provide a symmetrical configuration. Thus, although the covering module 50 is not individually reversible, it can be coupled to a selected side of any similar covering module along either of two of its sides depending upon the orientation of adjacent ones of the modules. Furthermore, the symmetrical covering module 50 provides double overlapping heat and vapor transmission seals when a plurality of such modules are assembled into a modular covering.

Figure 7:
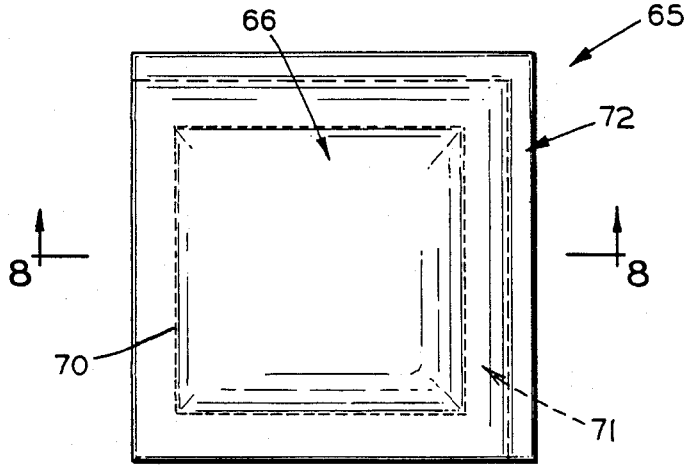
FIG. 7 is a top plan view of a third embodiment of the covering module according to the present invention.
Figure 8:
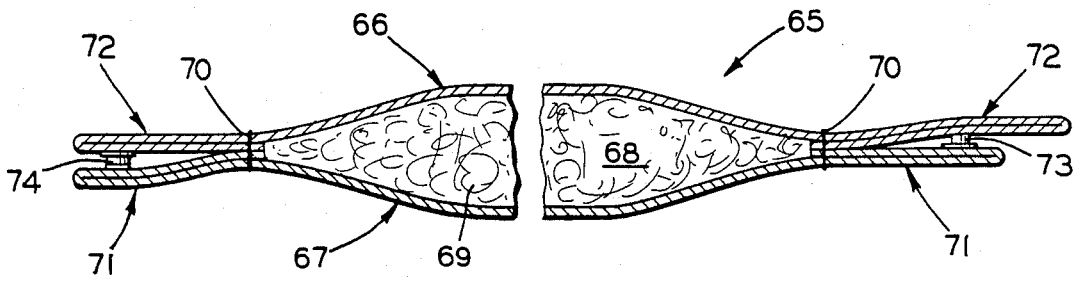
FIG. 8 is a cross-sectional view taken along the line 7—7 in FIG. 7.

An asymmetrical two flange covering module 65 is shown in FIG. 7 and FIG. 8. The covering module 65 is defined by a pair of sheets of flexible material, a top sheet 66 and a bottom sheet 67. The sheets and 67 are fastened together to define an interior space 68 which can be filled with stuffing or insulation material 69. In the covering module 65, the central portion defining the interior space 68 is formed by stitching 70. Extending from the edge of the central portion is a first flange 71 which is of the same width all the way around the central portion. Positioned above the first flange 71 is a second outer flange 72 which is the same width as the first flange along two sides of the central portion and is of a greater width along the remaining two sides to form an overhang. The covering module 65 can be provided with fastening means such as a plurality of male snap fastener means 73 attached to an upper surface of the first flange 71 extending under the wider two sides of the second outer flange 72. The remaining two sides of the second outer flange 72 have a plurality of female snap fastener means 74 attached to their under surfaces.

Figure 9:
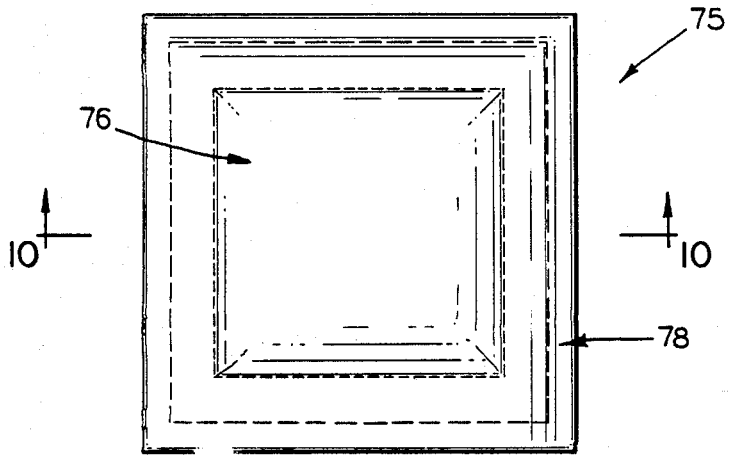
FIG. 9 is top plan view of a fourth embodiment of a covering module according to the present invention.
Figure 10:
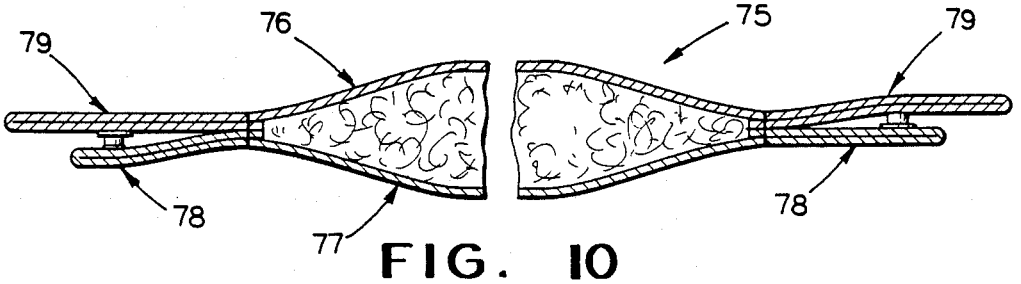
FIG. 10 is cross-sectional view taken along the line 8—8 in FIG. 9.

There is shown in FIG. 9 and FIG. 10 a covering module 75 which has a two flange symmetrical configuration. The module 75 is formed of a top sheet 76 and a bottom sheet 77 in a manner similar to the covering module 65. However, a first flange 78 extending from the periphery of the central portion of the covering module 75 is evenly overlapped by a second flange 79.

Figure 11:
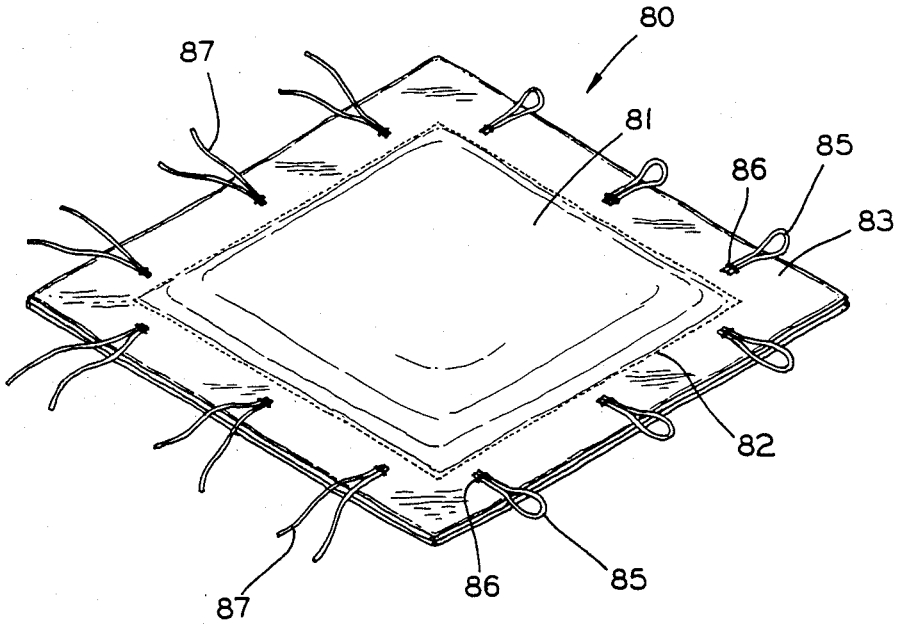
FIG. 11 is a perspective view of a covering module showing a loop and tie fastener means.
Figure 12:
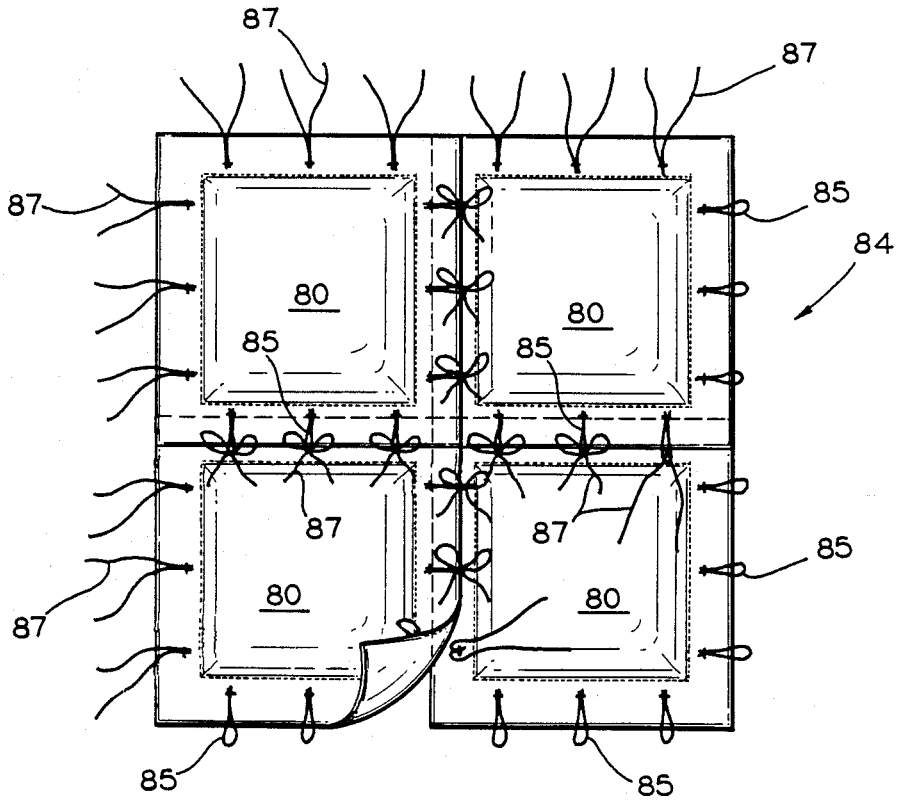
FIG. 12 is a top plan view of four of the covering modules of FIG. 10 coupled together to form a modular energy saving covering.

The covering modules 31, 50, 65 and 75 can be formed of any suitable flexible materials and the stitching is representative of any suitable means for defining the central portion in the flanges. One construction method for forming such a covering module is shown in U.S. Pat. No. 4,631,765. The module disclosed in this patent is shown in FIG. 11 and FIG. 12 as a module 80 having a central body portion 81 with a peripheral edge defined by stitching 82 and a single flange 82 extending from the peripheral edge of the central body portion 81.

The covering module 80 differs from the covering module shown in U.S. Pat. No. 4,631,765 in that a plurality of loop and double strap tie fastener means are utilized to assemble a plurality of the modules 80 together to form a modular covering 84 as shown in FIG. 12. A plurality of loop fasteners 85 are positioned inwardly from the peripheral edge of the flange 83 and can be attached to the flange by any suitable means such as by stitching 86. The loops 85 are spaced apart by a predetermined distance along two sides of the flange 83. A plurality of double strand tie fastener means 87 are spaced apart the same predetermined distance along the remaining two sides of the flange 83 and are attached to the flange by any suitable means such as stitching 86. As shown in FIG. 12, the loop containing sides of the flanges 83 are overlapped on top of the tie carrying sides of the flanges and the ties 87 are utilized to releasably engage the corresponding ones of the loops 85 to form the modular covering 84. The overlapping flanges provide a heat transmission and water vapor transmission barrier for the spaces between the central body portions 81 of the covering modules 80.

Figure 13:
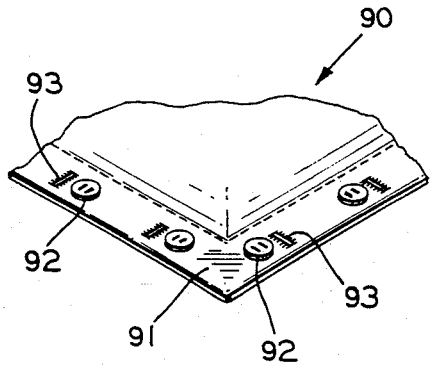
FIG. 13 is a fragmentary perspective view of a button and a button hole fastener means.

The type of fastener means and the placement of the fastener means on the flanges will determine whether the covering module is reversible and/or can be oriented in more than one position when being coupled to other such covering modules to form a modular covering. Various types of fastener means for use with single flange, two flange and three flange covering modules are shown in FIG. 13 through FIG. 23. However, only a single flange has been shown in the interests of clarity and illustration and any suitable fastener can be used. In FIG. 13, a covering module 90 has a first flange 91 to which are attached a plurality of buttons 92. Adjacent each of the buttons 92 is formed a button hole 93 extending through the flange 91. Such an arrangement of fastener means renders the covering module 90 reversible and permits any side of the module to be coupled to any side of another such module.

Figure 14:
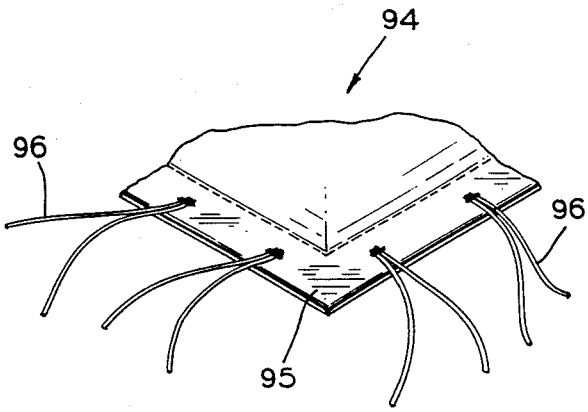
FIG. 14 is a fragmentary perspective view of a two strand tie fastener means.
Figure 15:
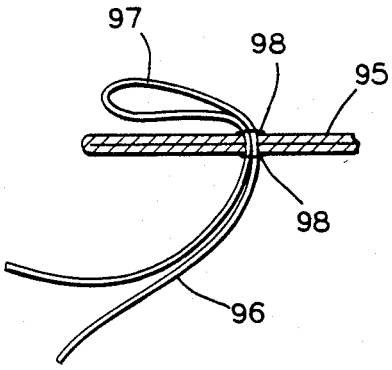
FIG. 15 is a fragmentary cross-sectional view of a double strand tie and integral loop fastener means.

There is shown in FIG. 14 a covering module 94 having a first flange 95 to which are attached a plurality of two strand ties 96. The ties 96 can be separate ties similar to those shown in FIG. 11 or can be integral with a loop 97 as shown in FIG. 15. In FIG. 15, a single line is doubled over and extended through an aperture formed in the flange 95 to form the double strand tie 96 and the loop 97. The line can be attached to the flange 95 by any suitable means such as stitching 98.

Figure 16:
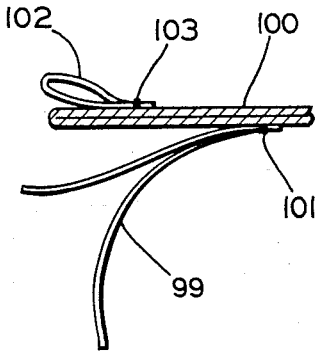
FIG. 16 is a fragmentary cross-sectional view of a double strand tie and separate loop fastener means.

An alternate embodiment of the double strand tie and loop fastener means is shown in FIG. 16. A double strand tie 99 is attached to one surface of a flange 100 by any suitable means such as stitching 101. A loop 102 is attached to the opposite side of the flange 100 by any suitable means such as stitching 103. The loop 102 is positioned adjacent the peripheral edge of the flange 100 while the attachment point for the tie 99 by the stitching 101 is spaced inwardly by approximately one to three inches depending on the dimensions of the covering module. Such spacing provides the necessary overlap for creating the heat energy and water vapor transmission barrier. The tie 99 and the loop 102 can also be formed from a single line.

Figure 17:
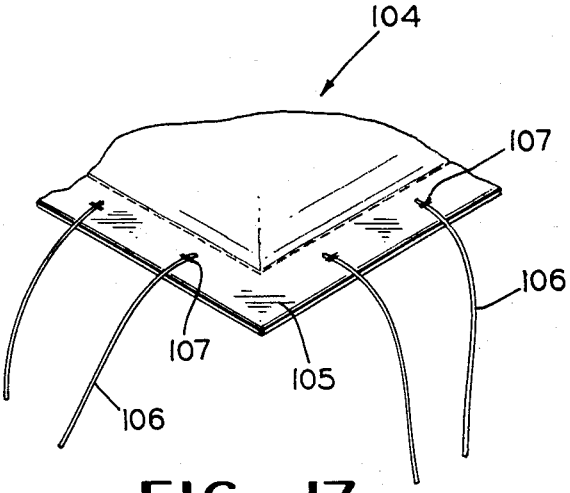
FIG. 17 is a fragmentary perspective view of a single strand tie fastener means.
Figure 18:
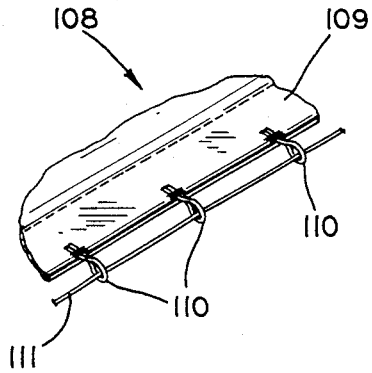
FIG. 18 is a fragmentary perspective view of a loop and cord fastener means.
Figure 19:
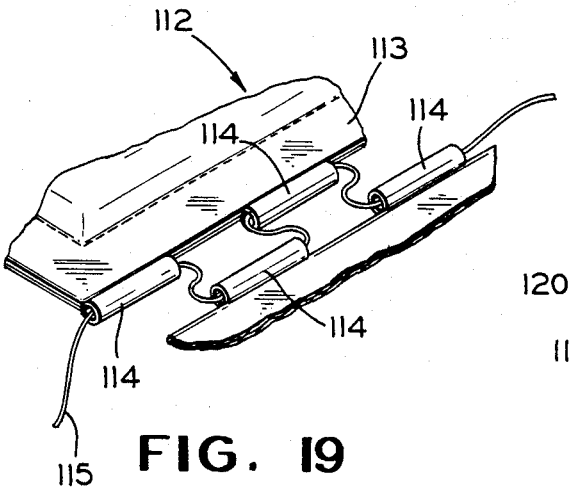
FIG. 19 is a fragmentary perspective view of a tube and cord fastener means.

In FIG. 17, there is shown a covering module 104 having a flange 105 to which single strand ties 106 are attached by stitching 107. In FIG. 18, a covering module 108 has a flange 109 to which a plurality of loops 110 have been attached. A cord 111 can be threaded through the loops 110 and through similar loops on any adjacent covering modules to couple the modules together to form a modular covering. In FIG. 19, a module 112 has a flange 113. A plurality of tubes 114 are attached to the outer periphery edge of the flange 113 and extend in a longitudinal direction parallel to the plane of the flange 113. A cord 115 can be threaded through the loops 114 and similar loops on adjacent covering modules to form a modular covering.

Figure 20:
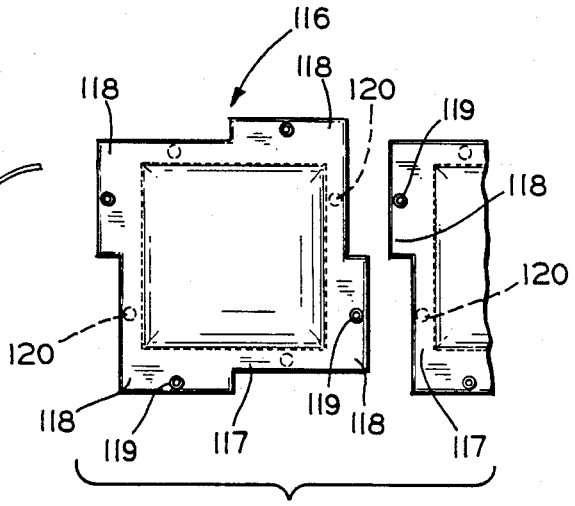
FIG. 20 is a top plan view of a pair of covering modules according to a fifth embodiment of the present invention.

Another form of fastening means is shown in FIG. 20. A covering module 116 includes a peripheral first flange 117 extending completely around a central portion thereof. Formed integral with and extending from the marginal edge portion of the flange 117 are a plurality of second flanges 118. Each of the second flanges 118 extends from one end of a side of the corresponding first flange 117 to the mid point of that side. A plurality of snaps 119 are attached to the second flanges 118 on one side of the first flange 117 and a plurality of cooperating snaps 120 are attached to the opposite side of the first flange 117. Thus, when two of the covering modules 116 are coupled together, the second flanges 118 overlie a corresponding portion of the first flange 117 on the adjacent covering module.

Figure 21:
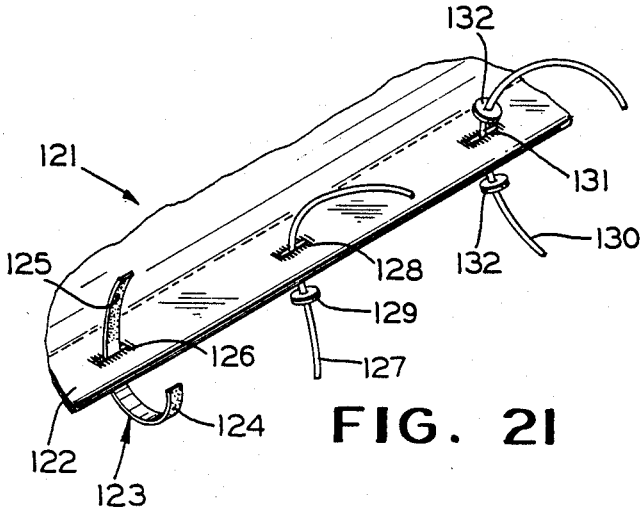
FIG. 21 is a fragmentary perspective view of three versions of a slide tie fastener means.

In FIG. 21, there are shown three types of sliding ties or straps utilized as fastener means in the present invention. A covering module 121 has a peripheral flange 122. A sliding tie or strap 123 has a plurality of hook fasteners 124 formed at one end and a plurality of loop fasteners 125 formed at the other end. The sliding tie 123 extends through a slot or button hole 126 formed in the flange 122. Thus, the hooks 124 and loops 125 can be attached together to form a loop fastener means from the sliding tie 123, or the hooks 124 and the loops 125 can be attached to loops and hooks respectively of another sliding tie from an adjacent covering module to couple the modules together. A second type of sliding fastener is formed from a single strand tie 127 which extends through a slot or button hole 128 formed in the flange 122. A button or disk 129 can be attached to the single strand tie 127 to prevent it from being pulled through the slot 128 in one direction. In yet another embodiment, a single strand tie 130 extends through a slot or button hole 131 formed in the flange 122. A pair of buttons or disks 132 are attached to the single strand tie 130, one on either side of the slot 131 to prevent the tie 130 from being pulled through the slot.

Figure 22:
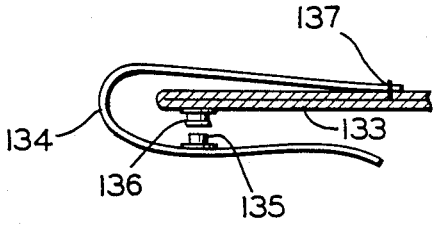
FIG. 22 is a fragmentary cross-sectional of a tie and snap fastener means.

In FIG. 22, there is shown a flange 133 and a single strand tie 134. A male snap fastener means 135 is attached to the tie intermediate its opposite ends. A cooperating female snap fastener means 136 is attached to one surface of the flange 133. One end of the single strand tie 134 is fastened to the opposite surface of the flange 133 by any suitable means such as stitching 137. Thus, when the snaps 135 and 136 are disengaged, the single strand tie can be utilized to engage a corresponding tie or a loop on an adjacent covering module. When the snaps 135 and 136 are engaged, the extent of the tie 134 between the snaps and the stitching 137 forms a loop which can be engaged by a tie on an adjacent covering module.

Figure 23:
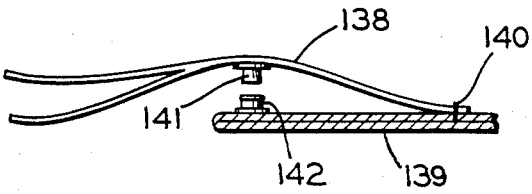
FIG. 23 is a fragmentary cross-sectional view of a double strand tie and snap fastener means.

A variation on the fastener means shown in FIG. 22 is shown in FIG. 23. A tie 38 is formed with a single strand on one end the free end of which is attached to a flange 139 by any suitable means such as stitching 140. The opposite end of the tie 138 separates into a double strand configuration and a male snap fastener means 141 is attached to the tie 138 adjacent the separation point. A cooperating female snap fastener means 142 is attached to the flange 139 between the stitching g140 and the peripheral edge of the flange 139. When the snaps 141 and 142 are disengaged as shown, the tie 138 can be utilized to engage a similar tie or a loop attached to a similar adjacent covering module. When the snaps 141 and 142 are engaged, a loop is formed between the snaps and the stitching 140 which can be engaged by a tie attached to an adjacent similar one of the covering modules.

Figure 24:
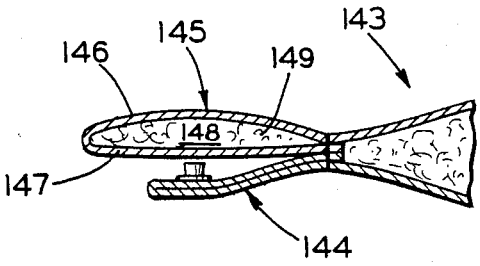
FIG. 24 is a fragmentary cross-sectional view of a covering module according to the present invention having a filled flange.

There is shown FIG. 24 a portion of a covering module 143 in cross-section. The module 143 includes a first flange 144 and a second flange 145 extending beyond and overlapping the first flange 144. The second flange 145 is formed with an upper wall 146 and a lower wall 147 which define an interior space 148 therebetween. The interior space 148 can be filled with stuffing or insulation material 149 to function as an additional infiltration barrier against heat energy transmission and water vapor transmission.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An energy saving covering module, adapted to be detachably connected to a plurality of like modules, comprising:

a central body portion having a pair of spaced apart walls attached together about peripheral edges defining an interior space therebetween; an insulating material positioned in said interior space;

a first flange extending from said peripheral edges of said central body portion;

a second flange extending from at least one of said peripheral edges of said central body portion beyond an outer peripheral edge of said first flange; and fastener means attached to one of said first flange and said second flange whereby said fastener means are adapted to cooperate with fastener means attached to adjacent ones of said covering modules to form a modular covering sheet with said second flanges overlying said first flanges of adjacent ones of said covering modules forming an infiltration barrier to the transmission of heat energy and water vapor from one side of the modular covering to the other side of the modular covering.

2. The covering module according to claim 1 including a third flange extending from at least one of said peripheral edges of said central body portion beyond an outer peripheral edge of said first flange whereby said third flanges overlie said first flanges of adjacent ones of said covering modules to form an infiltration barrier when a plurality of said covering modules are coupled together.

3. The covering module according to claim 2 wherein said second flange and said third flange are positioned symmetrically with respect to said first flange.

4. The covering module according to claim 2 wherein said third flange has a pair of spaced apart walls attached together about peripheral edges defining a space therebetween and including insulating material positioned in said third flange interior space.

5. The covering module according to claim 2 wherein said second flange and said third flange are positioned asymmetrically with respect to said first flange.

6. The covering module according to claim 1 wherein said second flange is positioned symmetrically with respect to said first flange.

7. The covering module according to claim 1 wherein said second flange is positioned asymmetrically with respect to said first flange.

8. The covering module according to claim 1 wherein said fastener means includes at least one male snap fastener means attached to one surface of a portion of said first flange and at least one female snap fastener means attached to an opposite surface of another portion of said first flange.

9. The covering module according to claim 1 including at least one of a male snap fastener means and a female snap fastener means attached to a surface of said first flange facing said second flange and at least one of a male snap fastener means and a female snap fastener means attached to a surface of said second flange facing said first flange.

10. The covering module according to claim 1 wherein said fastener means includes at least one tie attached to a surface of said first flange and at least one loop attached to an opposite surface of said first flange.

11. The covering module according to claim 10 wherein said tie is a two strand tie.

12. The covering module according to claim 11 wherein said tie and loop are formed of a single line extending through an aperture formed in said first flange.

13. The covering module according to claim 10 wherein said loop is spaced farther from said central body portion than said tie.

14. The covering module according to claim 1 wherein said fastener means includes a plurality of loops attached to said one of said first flange and second flange and a cord adapted to extend through said loops.

15. The covering module according to claim 1 wherein said fastener means includes a plurality of tubes attached to an outer peripheral edge of said one of said first flange and second flange and a cord adapted to extend through said loops.

16. The covering module according to claim 1 wherein said fastener means includes a tie having one end attached to said one of said first flange and said second flange and having one of a male and female snap fastener means attached intermediate said one end and an opposite end of said tie whereby said tie forms a loop when said one of said male and female snap fastener means engages a cooperating snap fastener means attached to said one of said first flange and said second flange.

17. The covering module according to claim 1 wherein said second flange has a pair of spaced apart walls attached together about peripheral edges defining a space therebetween and including insulating material positioned in said second flange interior space.

18. The covering module according to claim 1 wherein said walls are formed of gas impermeable material and said insulating material is a gas.

19. The covering module according to claim 1 including a bladder formed of a gas impermeable material positioned in said interior space and wherein said insulating material is a gas in said bladder.

20. An energy saving modular covering comprising:

a plurality of covering modules each formed of flexible material and having an insulating central body portion surrounded by an outwardly extending first flange;

a second flange formed on each of said covering modules extending from said central body portions beyond said first flange; and fastener means attached to at least one of said first flange and said second flange on each of said covering modules whereby said fastener means of adjacent ones of said covering modules cooperate to releasably couple said modules together to form the modular covering and said second flanges of each of said covering modules overlie said first flanges of each of said adjacent ones of said covering modules to form infiltration barriers militating against the transmission of heat energy and water vapor from one side of the modular covering to the other side.

21. The modular covering according to claim 20 including a third flange extending from at least one of said peripheral edges of said central body portion beyond an outer peripheral edge of said first flange whereby said third flanges overlie said first flanges of adjacent ones of said covering modules to form an infiltration barrier.

22. An energy saving covering module, adapted to be detachably connected to a plurality of like modules, comprising:

a central body portion having a pair of spaced apart walls attached together about peripheral edges defining an interior space therebetween;

an insulating material positioned in said interior space;

a first flange extending from said peripheral edges of said central body portion;

a second flange extending from one of said peripheral edges of said central body portion and outer peripheral edges of said first flange; and fastener means attached to at least one of said first flange and said second flange whereby said fastener means are adapted to cooperate with fastener means attached to adjacent ones of said covering modules to form a modular covering sheet with said second flanges overlying said first flanges of adjacent ones of said covering modules forming an infiltration barrier to the transmission of heat energy and water vapor from one side of the modular covering to the other side of the modular covering.

23. The covering module according to claim 22 wherein said walls, said first flange and said second flange are formed from a waterproof material.

24. The covering module according to claim 22 wherein said insulating material is a gas.

* * * * *